US006123770A

United States Patent [19]

Koskinen et al.

[11] Patent Number: 6,123,770

[45] Date of Patent: Sep. 26, 2000

[54] APPARATUS FOR COATING A PAPER WEB

[75] Inventors: Jukka Koskinen, Helsinki; Vilho Nissinen, Järvenpää, both of Finland

[73] Assignee: Valmet Corporation, Helsinki, Finland

[21] Appl. No.: 08/237,034

[22] Filed: May 3, 1994

Related U.S. Application Data

[62] Division of application No. 08/151,510, Nov. 12, 1993, abandoned.

[30] Foreign Application Priority Data

Nov. 13, 1992 [FI] Finland ..... 925168

[51] Int. Cl.[7] ..... B05C 11/02

[52] U.S. Cl. ..... 118/110; 118/119; 118/126; 118/249; 118/413

[58] Field of Search ..... 427/355, 356, 427/359, 361, 365, 369; 118/110, 126, 244, 248, 249, 403, 407, 409, 413, 119

[56] References Cited

U.S. PATENT DOCUMENTS

| | | | |
|---|---|---|---|
| 2,249,088 | 7/1941 | Murray | 118/126 |
| 2,252,345 | 8/1941 | Johnson | 427/359 |
| 2,312,927 | 3/1943 | Murray | 118/126 |
| 2,711,156 | 6/1955 | Bauling | 118/126 |
| 3,019,130 | 1/1962 | Hornbostel | 427/356 |
| 3,088,842 | 5/1963 | Kultnel | 118/126 |
| 3,863,597 | 2/1975 | Anselrode | 118/126 |
| 3,870,778 | 3/1975 | Steel | 264/164 |
| 4,041,197 | 8/1977 | Gagné | 427/359 |
| 4,416,922 | 11/1983 | Fridhandler | 427/359 |
| 4,856,454 | 8/1989 | Steberth et al. | 118/126 |
| 4,973,441 | 11/1990 | Keller | 427/361 |

FOREIGN PATENT DOCUMENTS

| | | |
|---|---|---|
| 0 436 172 A1 | 7/1991 | European Pat. Off. . |
| 88733 | 7/1987 | Finland . |
| 893468 | 1/1990 | Finland . |
| 905757 | 7/1991 | Finland . |

*Primary Examiner*—Peter Chin

*Attorney, Agent, or Firm*—Cohen, Pontani, Lieberman & Pavane

[57] ABSTRACT

An apparatus for coating a paper web in which a coating mix is applied onto a paper web using an applicator unit which forms a linear mechanical force on the web against a first backing surface situated on the back side of the web. The coating mix applied onto the web is doctored using a doctor unit acting against a second backing surface. The speed of at least one of the backing surfaces is independently controlled relative to the speed of the first backing surface and the web speed in order to attain control of the tensile stress of the web.

11 Claims, 5 Drawing Sheets

APPARATUS FOR COATING A PAPER WEB

RELATED APPLICATIONS

This is a divisional of pending application Ser. No. 08/151,510 filed on Nov. 12, 1993.

BACKGROUND OF THE INVENTION

1. Field of the Invention

The present invention relates to a method for coating a paper web. The invention also concerns an apparatus for coating a paper web.

2. Description of the Prior Art

According to prior-art techniques, a coating mix layer is first metered onto a paper web using an applicator apparatus and the coat is next smoothed with the help of a doctor blade working against the backing roll of the coater station.

Particularly in coater stations equipped with a nozzle applicator, certain operating conditions have invoked runability problems of the web to be coated owe to the fact that the applicator apparatus and the actual doctor blade form two linear fixing points of the web onto a single backing roll. Air conveyed along with the surface texture of the paper web remains pocketed between the web and the backing roll in the area delimited by said two web fixing points. Then, an irregularly shaped air pouch called "blowing" can develop in the area between the web fixing points owe to such causes as, for instance, an uneven distribution of web tension. The forces exerting either a web braking or pulling effect at the web fixing points behave so as to allow web slackening in the area between the web fixing points. Furthermore, the web moisture content increases upon the application of the coating mix, whereby the web tends to swell between the web fixing points. This phenomenon causes additional slackening of the web.

Given an uneven tensile, thickness, porosity or other profile across the web, web slackening occurs irregularly across the web within the area between the web fixing points. This may cause curling in the machine direction, which in turn may result in creasing.

SUMMARY OF THE INVENTION

It is an object of the present invention to overcome the drawbacks of the above-described techniques and to achieve an entirely novel method and apparatus for coating a paper web.

The present invention is based on arranging the application step and the actual doctoring step so that either step is performed against a separate backing surface. Of these backing surfaces, at least the latter either pulls the web forward or at least moves substantially at equal speed with the web.

Pursuant to the above-mentioned object, and others which will become apparent hereafter, one aspect of the inventive method resides in applying a coating mix onto the paper web using an applicator unit which forms a linear fixing point of the web against a first backing surface situated on the back side of the web. The coating mix is doctored using a doctor unit acting against a second backing surface. Each of the backing surfaces moves, and at least one of the backing surfaces has a speed that is independently controlled relative to the speed of the other backing surface or the web in order to maintain control of the tensile stress of the web.

One aspect of the inventive apparatus resides in an apparatus comprised of an applicator unit, a first backing surface placed against the applicator unit, a doctor unit and a second backing surface which acts against the doctor unit. The second backing surface is separate from the first backing surface and has a speed which is independently adjustable relative to the web speed and the tangential speed of the first backing surface.

The present invention provides significant benefits. Owing to the separate backing surfaces, improved control of web tension between the web fixing points is attained and the above-mentioned deleterious blowing or slackening of the web between the fixing points can be prevented.

In the following, the present invention is described in greater detail with the help of exemplifying embodiments illustrated in the annexed drawings.

For a better understanding of the present invention, its operating advantages, and specific object attained by its use, reference should be had to the drawing and descriptive matter in which there are illustrated and described preferred embodiments of the invention.

BRIEF DESCRIPTION OF THE DRAWINGS

FIG. 6 shows a side view of another embodiment of the apparatus according to the present Invention.

DETAILED DESCRIPTION OF THE PREFERRED EMBODIMENTS

The arrangement according to the present invention achieves its greatest benefits in conjunction with coaters forming a web fixing point, e.g., nozzle coaters equipped with metering/smoothing blades, while the presenting invention is also suited for use with roll coaters.

Figure 1:
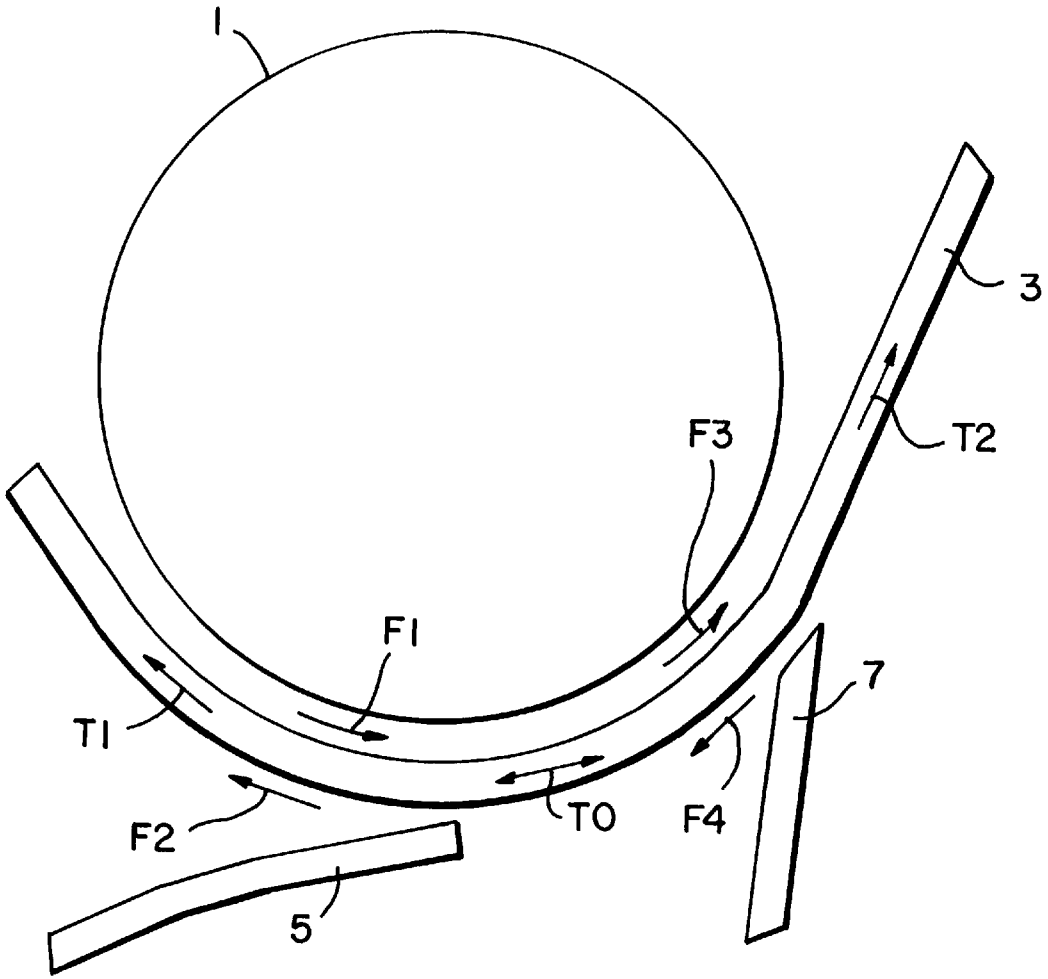
FIG. 1 shows diagrammatically the forces typically involved in a prior-art embodiment.

With reference to FIG. 1, the tensile stress TO of a web 3 between the blades 5, 7 is expressed by the formula $$TO=T1+T2+F2+F3-F1-F4, \text{ where}$$

T1 is the tensile stress imposed in the web 3 by the preceding rolls,

T2 is the tensile stress imposed in the web 3 by the rolls subsequent to the nip, F2 is the force imposed in the web 3 by the metering/smoothing blade 5, F3 is the force imposed in the web 3 by the roll 1 in the nip between the roll 1 and the metering/smoothing blade 5, F1 is the force imposed in the web 3 by the roll 1 in the nip between the roll 1 and the doctor blade 7, and F4 is the force imposed in the web 3 by the doctor blade 7.

In this context, the force variables F1–F4 must be understood as the imposed total force divided by the web cross section.

Figure 2:
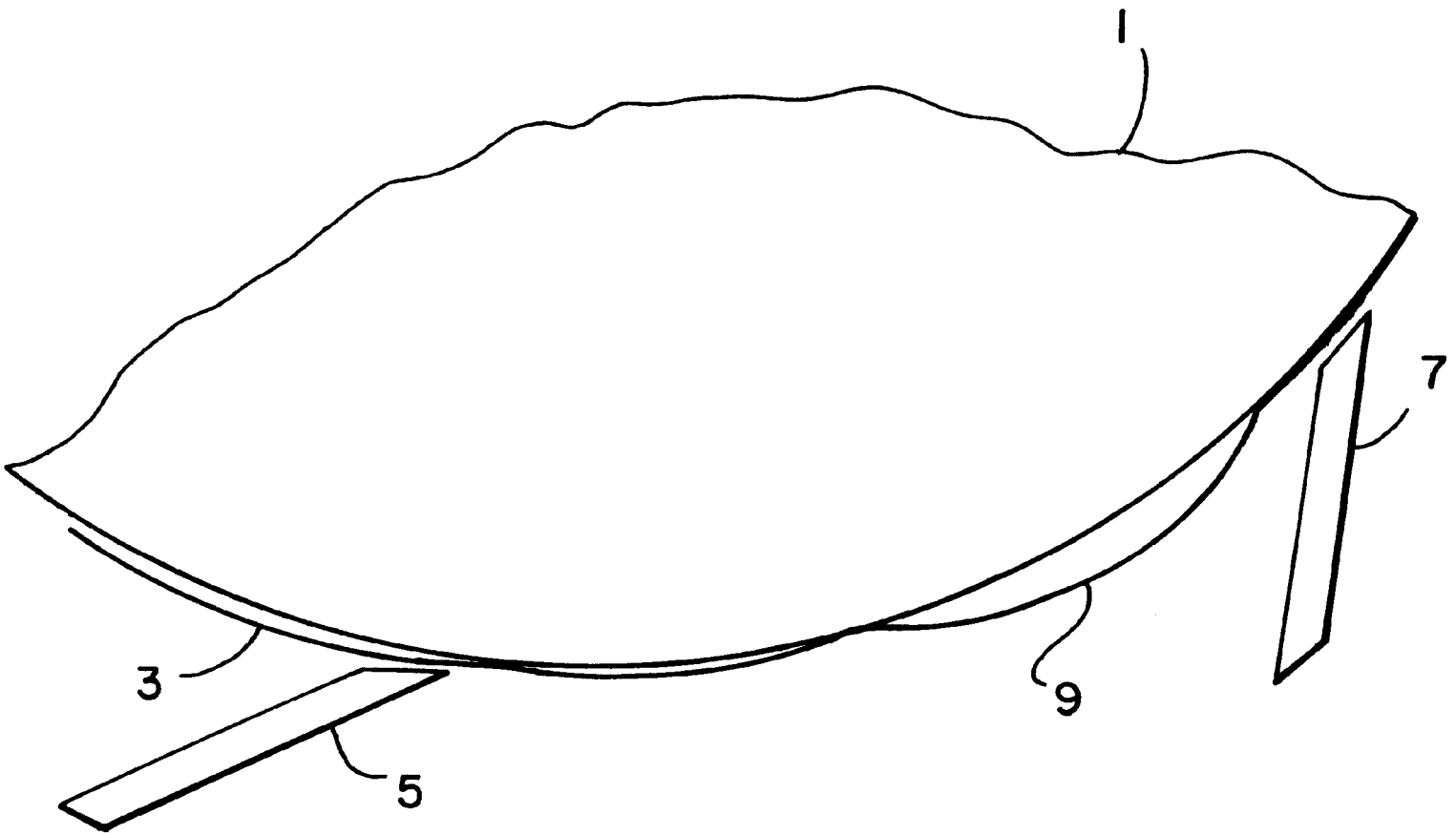
FIG. 2 shows in a diagrammatic side view the blowing effect caused by the forces illustrated in FIG. 1.

With reference to FIG. 2, two web fixing points cause an air pouch 9, which at its worst can result in web creasing when reaching the nip between the roll 1 and the doctor blade 7.

Figure 3B:
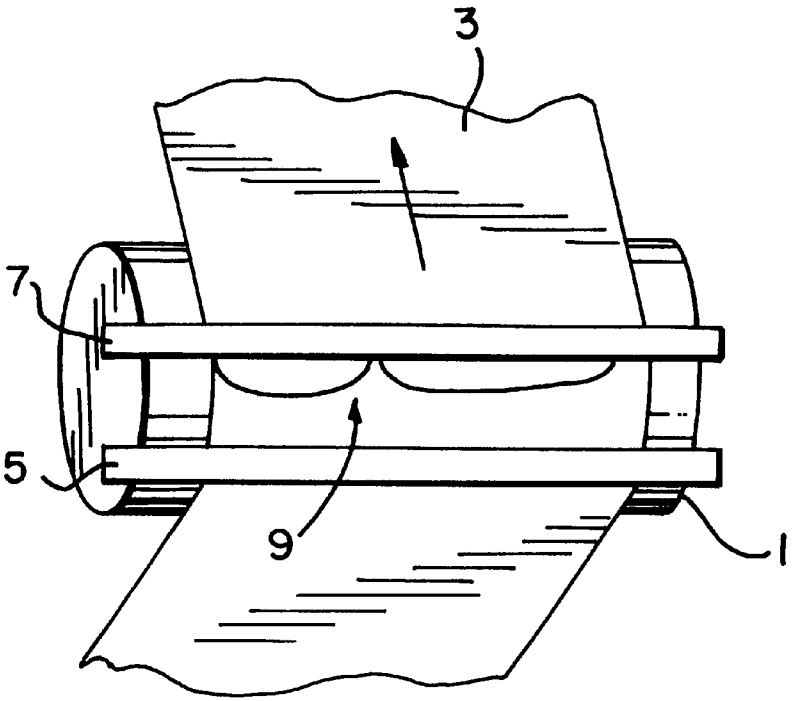
FIG. 3*b* shows in a diagrammatic front view an unstable blowing effect caused by the forces illustrated in FIG. 1.
Figure 3A:
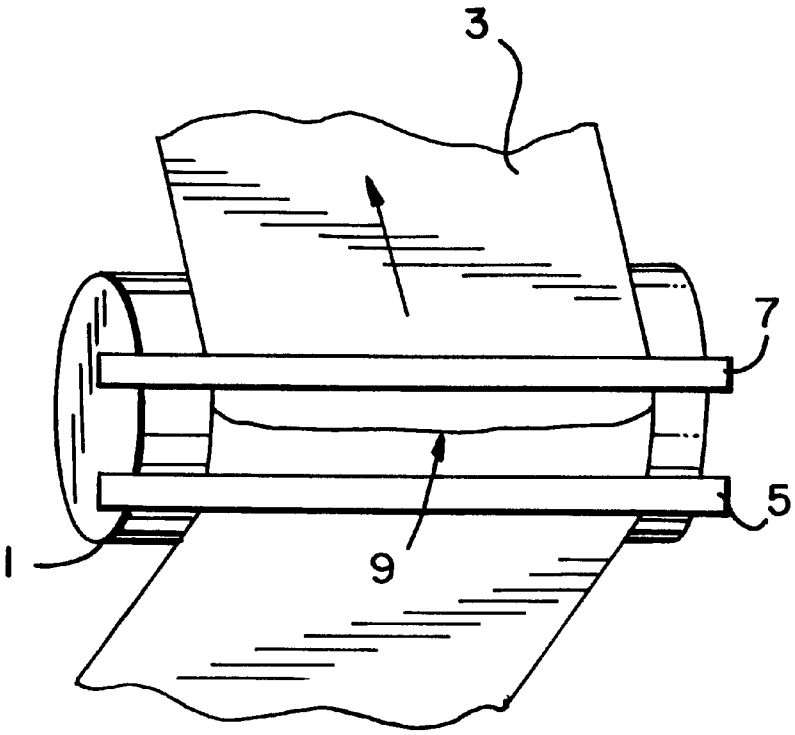
FIG. 3*a* shows in a diagrammatic front view a stable blowing effect caused by the forces illustrated in FIG. 1.

FIG. 3*a* shows a stable situation in which an air pouch 9 has developed in front of the doctor blade 7 owe to excessive tensile stress TO. As the height of the airpouch 9 in this case is constant across the web, the situation is stable.

FIG. 3*b* in contrast illustrates an unstable running situation in which the height of the air pouch 9 varies across the web 3.

Figure 4:
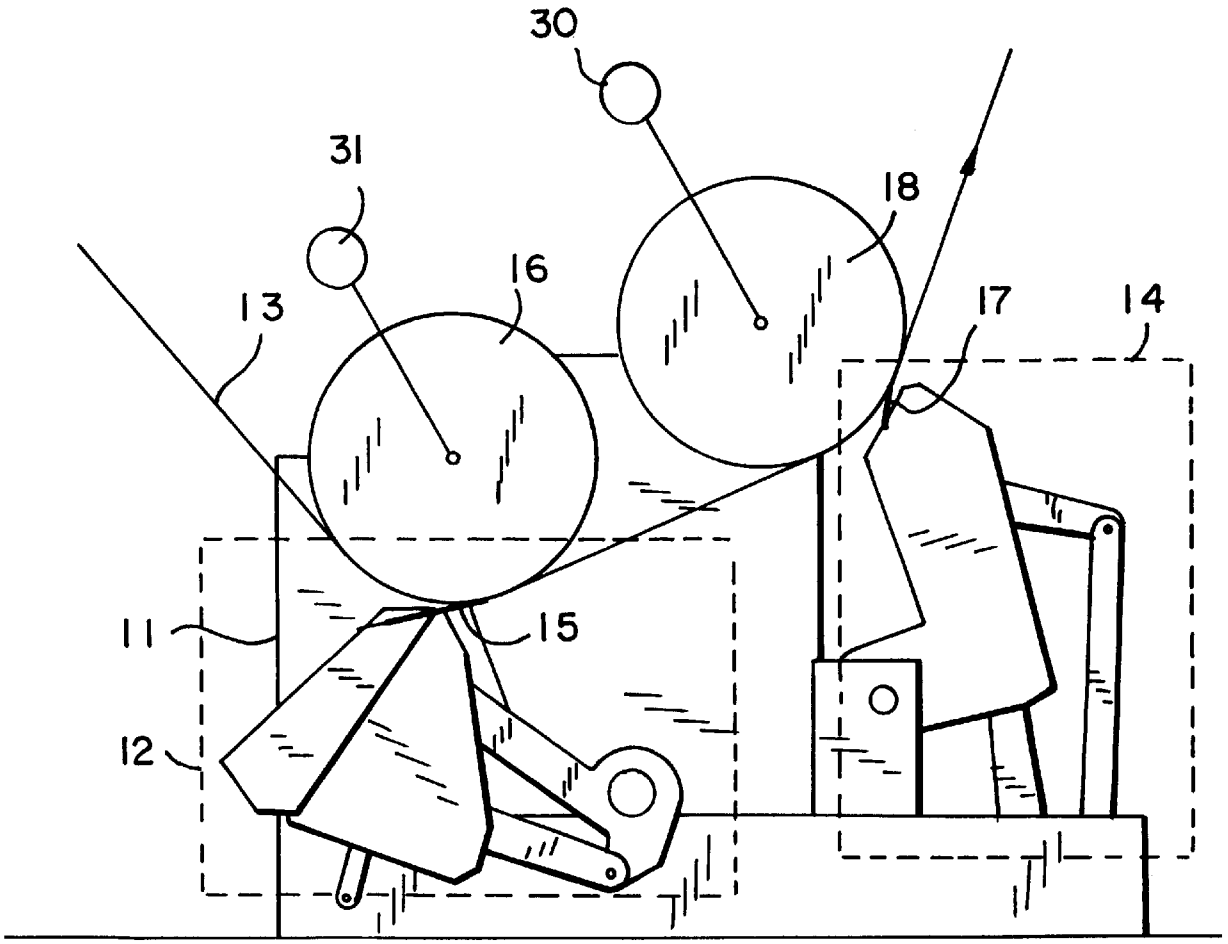
FIG. 4 shows a side view of an embodiment of the apparatus according to the present invention.

With reference to FIG. 4, the web runability problems are solved according to the present invention by placing the applicator 12 against the first backing roll 16 and the doctoring unit 14 against a second backing roll 18. In this manner, the tensile stress of a web 13 between the first linear web fixing point formed at the metering/smoothing blade 15 and the second linear web fixing point formed at the doctor blade 17 can be controlled, for example, by controlling the rotational speed of the second backing roll 18 by adjustable speed motor 30. However, the tensile stress of the web 13 can also be implemented through a speed control of the first backing roll 16 by adjustable speed motor 31. Typically, the tangential speed of the second backing roll 18 is essentially equal to or higher than the speed of the web 13.

Figure 5:
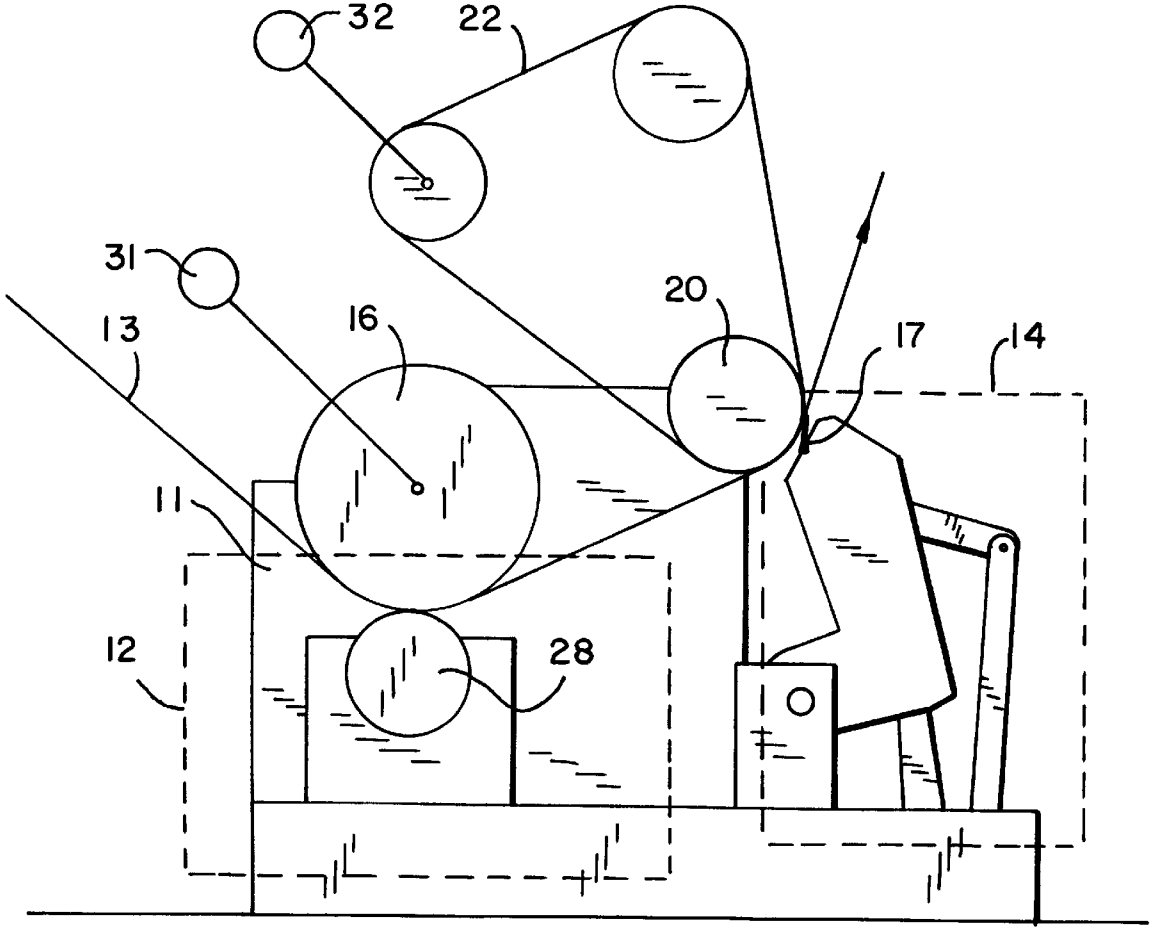
FIG. 5 shows a side view of an alternative embodiment of the apparatus according to the present invention.

With reference to FIG. 5, the metering/smoothing blade can be replaced by a roll applicator 28. In the embodiment illustrated herein, the second roll 18 shown in FIG. 4 is replaced by a smaller-diameter roll 20 on which a backing belt 22 with adjustable speed runs by means, for example, of an adjustable speed motor 32.

In both above-described embodiments the tangential speed of the second backing roll 18 or the backing belt 22, respectively, is essentially equal to or higher than the speed of the web 13.

Alternatively, as shown in FIG. 6, the operation of first backing roll 16 shown in FIG. 5 may be assisted by air 26 injected by an air injection means 27 between the first backing roll 16 and the web 13, whereby the web 13 runs on an air cushion against the roll applicator 28. Then, the tensile stress of the web 13 is adjusted through the speed control of the backing belt 22 by means, for example, of an adjustable speed motor 32.

For reasons of spatial limitations in paper machines, the rolls 16 and 18 preferably have a small diameter. Therefore, a backing belt arrangement 22 such as shown in FIG. 5 is according to the present invention preferred for the space savings it offers.

Further, the small dimensions of the backing roll/belt arrangements also provide a reasonable distance between the metering/smoothing blade or roll and the doctor blade as required by the coating technique employed.

Obviously, the backing belt arrangement 20, 22 shown in FIG. 5 can also be implemented to replace the first backing roll 16. Further, even both backing rolls can be replaced by backing belts, respectively, in the same embodiment.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for coating a paper web, comprising:

a coating mix applicator unit for applying a coating mix to the web;

a first moving backing surface placed so as to back said applicator unit;

a doctor unit positioned so as to smooth the coating mix after it is applied to the web;

a second moving backing surface arranged so as to act against said doctor unit, said second backing surface being separate from said first backing surface; and drive means for controlling a speed of at least one of the backing surfaces relative to the speed of the other backing surface to control tensile stress of the web between said coating mix applicator unit and said doctor unit.

2. An apparatus as defined in claim 1, wherein said drive means comprises independent drive means for each of the backing surfaces.

3. An apparatus as defined in claim 1, wherein at least one of the backing surfaces is a backing belt.

4. An apparatus as defined in claim 1, wherein at least one of said backing surfaces is a backing roll.

5. An apparatus as defined in claim 1, further comprising an air injection means for injecting air between said first backing surface and the web so as to cause the web to contact said coating mix applicator unit.

6. An apparatus as defined in claim 1, wherein said drive means comprises a first drive means for controlling the speed of said first backing surface and a second drive means for controlling the speed of said second backing surface.

7. An apparatus for coating a paper web, comprising:

a metering blade for applying a coating mix to the web;

a first moving backing surface placed so as to back said metering blade;

a doctor blade positioned so as to smooth the coating mix after it is applied to the web;

a second moving backing surface arranged so as to act against said doctor blade, said second backing surface being separate from said first backing surface; and drive means for controlling a speed of at least one of the backing surfaces relative to the speed of the other backing surface to control tensile stress of the web between said metering blade and said doctor blade.

8. An apparatus as defined in claim 7, wherein said drive means comprises independent drive means for each of the backing surfaces.

9. An apparatus as defined in claim 7, wherein at least one of the backing surfaces is a backing belt.

10. An apparatus as defined in claim 7, wherein at least one of said backing surfaces is a backing roll.

11. An apparatus as defined in claim 7, wherein said drive means comprises a first drive means for controlling the speed of said first backing surface and a second drive means for controlling the speed of said second backing surface.

* * * * *